US006555220B1

(12) United States Patent
Koyanagi et al.

(10) Patent No.: US 6,555,220 B1
(45) Date of Patent: Apr. 29, 2003

(54) COMPOSITE FIBER HAVING FAVORABLE POST-TREATMENT PROCESSIBILITY AND METHOD FOR PRODUCING THE SAME

(75) Inventors: Tadashi Koyanagi, Nobeoka (JP); Takao Abe, Nobeoka (JP); Teruhiko Matsuo, Nobeoka (JP); Yousei Mitsumori, Miyazaki (JP)

(73) Assignee: Asahi Kasei Kabushiki Kaisha, Osaka (JP)

( * ) Notice: Subject to any disclaimer, the term of this patent is extended or adjusted under 35 U.S.C. 154(b) by 0 days.

(21) Appl. No.: 10/060,362

(22) Filed: Feb. 1, 2002

(30) Foreign Application Priority Data

| | | |
|---|---|---|
| Feb. 2, 2001 | (JP) | 2001-027064 |
| Jun. 26, 2001 | (JP) | 2001-192823 |
| Oct. 15, 2001 | (JP) | 2001-317153 |

(51) Int. Cl.[7] ..... D01F 6/00; D01F 8/00

(52) U.S. Cl. ..... 428/373; 428/364; 428/370; 428/374; 428/395

(58) Field of Search ..... 428/370, 373, 428/374, 364, 395

(56) References Cited

U.S. PATENT DOCUMENTS

| | | | | |
|---|---|---|---|---|
| 3,671,379 A | | 6/1972 | Evans et al. | 161/173 |
| 6,306,499 B1 | | 10/2001 | Ochi et al. | 428/364 |
| 6,423,407 B1 | * | 7/2002 | Abe et al. | 428/364 |

FOREIGN PATENT DOCUMENTS

| | | |
|---|---|---|
| EP | 1 059 372 | 12/2000 |
| GB | 965729 | 8/1964 |
| JP | 11-189923 | 7/1999 |
| JP | 11189923 A | 7/1999 |
| JP | 2000-136440 | 5/2000 |
| JP | 2000-239927 | 9/2000 |
| JP | 2000-256918 | 9/2000 |
| JP | 3204399 | 9/2001 |
| JP | 2001-348734 | 12/2001 |
| JP | 2001348734 A | 12/2001 |
| WO | WO99/11845 | 3/1999 |
| WO | WO 99/39041 | 8/1999 |
| WO | WO00/22210 | 4/2000 |

* cited by examiner

*Primary Examiner*—N. Edwards
(74) *Attorney, Agent, or Firm*—Finnegan, Henderson, Farabow, Garrett & Dunner, L.L.P.

(57) ABSTRACT

The present invention provides a polytrimethylene terephthalate composite fiber characterized in that the composite fiber is a plurality of single filament which comprises two kinds of polyester components laminated to each other in a side-by-side manner or an eccentric sheath-core manner, at least one polyester component is polytrimethylene terephthalate and the composite fiber satisfies the following conditions: the content of trimethylene terephthalate cyclic dimer in polytrimethylene terephthalate is 2.5 wt % or less, the fiber-fiber dynamic friction coefficient is from 0.2 to 0.4, the degree of intermingling is from 2 to 60 point/m and/or the number of twists is from 2 to 60 T/m and the fiber size fluctuation U% is 1.5% or less.

7 Claims, 5 Drawing Sheets

COMPOSITE FIBER HAVING FAVORABLE POST-TREATMENT PROCESSIBILITY AND METHOD FOR PRODUCING THE SAME

TECHNICAL FIELD

The present invention relates to a polytrimethylene terephthalate composite fiber and a method for producing the same.

BACKGROUND ART

A polytrimethylene terephthalate (hereinafter referred to as PTT) fiber have been known in the prior documents such as J. Polymer Science: Polymer Physics Edition Vol. 14, pages 263 to 274 (1976) or Chemical Fibers International Vol. 45, pages 110 to 111 April (1995).

These documents describe a basic characteristic of a stress-strain property of the PTT fiber; that is, the PTT fiber is low in initial modulus and excellent in elastic recovery, which is suitable for clothing and carpet use.

Japanese Examined Patent Publication No. 43-19108, Japanese Unexamined Patent Publication Nos. 11-189923, 2000-239927 and 2000-256918, and EP1059372A disclose a side-by-side type composite fiber containing PTT as one component or two components thereof.

These prior documents disclose that a side-by-side type or an eccentric sheath-core type composite fiber in which PTT is used as at least one component thereof (hereinafter referred to as a PTT composite fibers) have a latent crimpability, and the crimps develop by heat treatment, and exhibit a favorable stretchability and a soft touch.

According to the study of the present inventors, although products obtained from the PTT composite fibers are excellent in stretchability and softness, problems have been found in the post-treatment process such as knitting/weaving or dyeing and the uniformity of dyed product as described in items I, II and III below:

I. Troubles in knitting/weaving process

As the preparation prior to the knitting/weaving, a warping process is employed before the knitting process, and a warp preparation process and a twist yarn preparation process are employed before the weaving process.

When the PTT composite fiber is used in a warp-knitting process, "opening of single filaments" may occur due to the tension fluctuation during the knitting operation, whereby the adjacent fibers are interfered with each other to result in filament breakage.

When a twist yarn is formed of the PTT composite fibers and used for producing a woven fabric, there is a problem in that white powder may be generated during the twisting and/or weaving process and is deposited on guides in the passage to result in the yarn breakage.

FIG. 1 is a simplified illustration of a photograph of the PTT composite fiber surface after being twisted and twist-set by wet heat observed by a scanning electronic microscope. It will be apparent from FIG. 1 that white powder is generally uniformly deposited on the surface of single filament.

FIG. 2 is an example of a chart obtained by measuring white powder deposited on a tension control guide of a loom in accordance with a differential scanning calorimetry (DSC).

This curve exhibits endothermic peaks at about 230° C. and about 250° C. The peaks at about 230° C. and at about 250° C. coincide with the melting temperature of PTT and that of a cyclic dimer of trimethylene terephthalate, respectively. Accordingly, it is apparent that the white powder deposited on a guide or others is PTT or trimethylene terephthalate cyclic dimer which is a by-product of the former.

The higher the crimpability of the developed crimps and the more of a number of twist, the more the white powder is derived from PTT. If the number of twists is 1000 T/m or more, the frictional abrasion of the twist yarn becomes so significant that an abrasive trace can be observed by a scanning electronic microscope. Thus, the PTT composite fiber is difficult to use as a high twist yarn.

Also, the higher the twist-setting temperature after being twisted, the more the white powder is derived from the cyclic dimer of trimethylene terephthalate.

While it is not apparent why such white powder is generated, one reason may be the following:

PTT composite fiber, especially that having a high stretchability, has not only latent crimpability but also developed crimps developed prior to being heat-treated; in other words, it is characterized as having apparent crimpability. It is surmised that such a side-by-side type composite fiber having developed crimpability is significantly higher in contact resistance with guides or others in the preparation process of knitting/weaving than that having non-developed crimpability to result in the generation of white powder.

Also, it is surmised that during the twist-setting process after twisting, trimethylene terephthalate cyclic dimer contained in a PTT composite fiber separates out from the fiber interior to the surface thereof to cause white powder.

There is a proposal in WO99/39041 to eliminate the yarn breakage during the spinning or false-twist texturing process by imparting PTT fiber with a special finishing agent. However, there is no description therein of the PTT composite fiber having the developed crimpability wherein crimps are developed.

Also, in the above prior document, there is no disclosure of the problem of the entanglement of fibers during the knitting process or the generation of white powder during the knitting/weaving process, much less the disclosure or suggestion of a solution thereto.

II. Troubles in dyeing process

It is known that, besides fabric dyeing or print dyeing, a dyed knit/woven fabric may be obtained by a yarn-dyeing method.

Since a pattern is formed in the knit/woven fabric obtained by the yarn-dyeing method wherein colors of the respective fibers are different from each other, a high-grade fashionable product results.

While the yarn-dyeing method includes hank dyeing or cheese dyeing, the latter is mainly used nowadays because of the dyeing economy thereof.

The knit/woven fabric obtained from the cheese-dyed PTT composite fibers more easily develops crimps during the dyeing process in comparison with a false-twist textured yarn of PTT or polyethylene terephthalate (hereinafter referred to as PET). Accordingly, if the cheese-dyed PTT composite fibers are used for the knit/woven fabric, there is a feature in that the favorable stretchability is obtained due to high crimps.

Contrary to such a feature, it has been found that, when the PTT composite fibers are cheese-dyed, oligomer extracted from the fiber is deposited on the dyed cheese to deteriorate the dyeing uniformity.

That is, when a dyeing liquid circulates from inside of the cheese to outside thereof, oligomer separated out from the PTT composite fibers is dissolved in the dye liquid and deposited on the fiber. The portion of the fiber on which the oligomer is deposited causes an uneven dyeing or a loss of color clarity. Dyeing troubles caused by oligomer are not limited only to cheese dyeing but also appear in fabric dyeing.

According to analysis by the present inventors, it has been found that a main component of the oligomer is a cyclic dimer of trimethylene terephthalate.

Although the reason is not apparent why a large amount of cyclic dimer is separated out from the PTT composite fibers, it is surmised that a low PTT orientation in the PTT composite fibers allows the cyclic dimer to move toward the fiber surface.

Japanese Patent No. 3204399 discloses a PTT fiber and refers to the content of oligomer in the PTT fiber for the purpose of restricting the contamination of orifices in a spinneret. However, the content is high and there is no disclosure at all of white powder being generated during the twisting, heat-setting and weaving of PTT composite fibers or oligomer troublesome in the dyeing process thereof.

Thus, PTT composite fibers free from troubles in the dyeing process are strongly desired.

III. Dyeing uniformity

The dyeing uniformity of a PTT composite fiber product is an important factor.

It has been found that the following two problems deteriorate the dyeing uniformity when the PTT composite fibers are industrially produced.

One of the problems is the yarn bending. If the difference in intrinsic viscosity between two polymers used is made to be larger for the purpose of improving the stretchability and the stretchback property of the resultant composite fibers, yarn bending is generated due to the difference in melting viscosity between the two polymers extruded from an orifice during the spinning, which causes fiber size fluctuation in the lengthwise direction of the resultant composite fiber.

The other of the problems is the contamination of the orifice from which the melted polymer is extruded. When the PTT is spun, polymer may deposit on the periphery of the orifice as the spinning time passes to result in the contamination so-called "eye mucus". This contamination is peculiar to PTT, and the larger the difference in intrinsic viscosity between the two polymers, the more significant this phenomenon becomes. It has been found that when the "eye mucus" generates, the extruded fiber becomes uneven (because of the generation of a so-called "jerk") not only to reduce the spinning stability but also increase the fiber size fluctuation U% of the composite fibers obtained. A fabric obtained from the PTT composite fibers having a large fiber size fluctuation is unevenly dyed to largely lower the product grade.

To solve the problem of yarn bending, a spinning method is proposed, in Japanese Examined Patent Publication (Kokoku) No. 43-19108, BP 965,729 and Japanese Unexamined Patent Publication (Kokai) No. 2000-136440, using a spinneret having orifices in which flow paths for two polymers are slanted.

Since the prior art disclosed in these documents, however, is a system in which two polymers having the difference in intrinsic viscosity are extruded from an orifice directly after they meet together, if the difference in melting viscosity between the two polymers is large, it is impossible to sufficiently prevent the deviation of a flow of melted polymer, and as a result, the fiber size fluctuation is not suppressed enough.

Accordingly, it is strongly desired that PTT composite fibers free from yarn breakage during the knitting/weaving process and having high stretchability, high stretchback property and dyeing uniformity, and a method for the production thereof, are developed.

DISCLOSURE OF THE INVENTION

An object of the present invention is to provide PTT composite fibers free from problems in the knitting/weaving process, such as yarn breakages due to the entanglement of fibers in the knitting process, yarn breakages due to white powder derived from polymer or oligomer in the weaving process as well as problems in the dyeing process such as uneven dyeing or loss of color clarity due to the deposition of oligomer, and are thus easily processible in post-treatment, such as the preparation for the knitting/weaving process, or the dyeing process.

The above-mentioned problems could not have been recognized at all in the prior art level, but are novel problems which have been found out for the first time by the present inventors who have been researching PTT composite fibers having developed crimps excellent in stretchability and stretchback property.

As a result of the diligent study conducted by the present inventors, it has been found that the above-mentioned problems can be solved by specifying an amount of cyclic dimer contained in the fiber and the identification of the surface characteristic and the collective configuration of the fiber, and thus the present invention has completed.

That is, the present invention is:

1. A PTT composite fiber characterized in that the composite fiber is a plurality of single filament which comprises two kinds of polyester components laminated to each other in a side-by-side manner or an eccentric sheath-core manner, at least one of which components is PTT and the composite fiber satisfies the following conditions (1) to (4):

(1) the content of trimethylene terephthalate cyclic dimer in PTT is 2.5 wt % or less, (2) the fiber-fiber dynamic friction coefficient is from 0.2 to 0.4, (3) the degree of intermingling is from 2 to 60 point/m and/or the number of twists is from 2 to 60 T/m, and (4) the fiber size fluctuation U% is 1.5% or less.

2. A PTT composite fiber as defined by the above item 1, characterized in that one of the polyester components forming the single filament is PTT and the other is polyester selected from a group of PTT, PET and polybutylene terephthalate.

3. A PTT composite fiber as defined by the above item 1, characterized in that the composite fiber is a plurality of single filament which comprises two kinds of polyester components laminated to each other in a side-by-side manner and the composite fiber satisfies the following conditions (1) to (6):

(1) both of the polyester components are PTT, (2) the content of trimethylene terephthalate cyclic dimer in PTT is 2.2 wt % or less, (3) the fiber-fiber dynamic friction coefficient is from 0.3 to 0.4, (4) the degree of intermingling is from 10 to 35 point/m and/or the number of twist is from 10 to 35 T/m, and (5) the fiber size fluctuation U% is 1.2% or less, and (6) the maximum crimp elongation of developed crimps is 50% or more.

4. A PTT composite fiber as defined by any one of the above items 1 to 3, characterized in that both of the two kinds of polyester components forming the single filament comprise 90 mol % or more of PTT, and the composite fiber has an average intrinsic viscosity from 0.7 to 1.2 dl/g, an elongation at break from 30 to 50% and a strength at break of 2.5 cN/dtex or more.

5. A PTT composite fiber as defined by any one of the above items 1 to 4, characterized in that the composite fiber is a plurality of single filament which comprises two kinds of polyester components laminated to each other in a side-by-side manner and a radius of curvature r ($\mu$m) of a boundary of the two components in the cross-section of the single filament is less than 10 $d^{0.5}$ (wherein d represents a single filament size (decitex)).

6. A PTT composite fiber as defined by any one of the above items 1 to 5, characterized in that the maximum crimp elongation of developed crimps is 50% or more.

7. A PTT composite fiber as defined by any one of the above items 1 to 6, characterized in that a crimp elongation recovery speed is 15 m/sec or more after the composite fiber is treated with boiling water.

8. A method for producing a PTT composite fiber by a melt-spinning method, characterized in that the composite fiber is a plurality of single filament which comprises two kinds of polyester components laminated to each other in a side-by-side manner or an eccentric sheath-core manner, at least one of which is PTT and the method satisfies the following conditions (a) to (d):

(a) the melting temperature is from 240 to 280° C. and the melting time is 20 minutes or less, (b) after the two kinds of polyester components have been joined together, the extrusion condition per one spinning orifice is such that the product of an average intrinsic viscosity [η] (dl/g) and an extrusion linear speed V (m/min) is from 3 to 15 (dl/g)·(m/min), (c) after the extruded polyester has been cooled and solidified, a finishing agent containing 10 to 80 wt % of fatty ester and/or mineral oil, or one containing 50 to 98 wt % of polyether having a molecular weight from 1000 to 20000 are imparted to the fiber at a ratio from 0.3 to 1.5 wt %, and (d) at any of the steps before the fiber has been finally wound, the interlacing and/or twist is imparted to the fiber.

9. A method for producing a PTT composite fiber by a melt-spinning method, characterized in that the composite fiber is a plurality of single filament which comprises two kinds of polyester components laminated to each other in a side-by-side manner and the method satisfies the following conditions (a) to (f):

(a) PTT having the content of trimethylene terephthalate cyclic dimer of 1.1 wt % or less is used as both of the components, (b) the melting temperature is from 255 to 270° C. and the melting time is 20 minutes or less, (c) after the two kinds of polyester components have been joined together, the extrusion condition per one spinning orifice is such that a ratio (L/D) of a length L to a diameter D of a spinning orifice is 2 or more and the spinning orifice has an inclination, relative to the vertical direction, from 15 to 35 degrees, (d) after the two kinds of polyester components have been joined together, the extrusion condition per one spinning orifice is such that the product of an average intrinsic viscosity [η] (dl/g) and an extrusion linear speed V (m/min) is from 5 to 10 (dl/g).(m/min), (e) after the extruded polyester has been cooled and solidified, a finishing agent containing 10 to 80 wt % of fatty ester and/or mineral oil, or one containing 50 to 98 wt % of polyether having a molecular weight from 1000 to 20000 is imparted to the fiber at a ratio from 0.3 to 1.5 wt %, and (f) at any of the steps before the fiber has been finally wound, an iterlacing and/or twist is imparted to the fiber.

10. A method for producing a PTT composite fiber as defined by the above items 8 or 9, characterized in that both of the two kinds of polyester components forming the single filament comprise 90 mol % or more of PTT, and the composite fiber has an average intrinsic viscosity from 0.7 to 1.2 dl/g.

The present invention will be described in more detail below.

The PTT composite fiber according to the present invention consists of a group of single filaments. Each of the single filaments consists of two kinds of polyester components laminated to each other in a side-by-side manner or an eccentric sheath-core manner and at least one of the components is PTT. Examples of the combination of two kinds of polyester are, for instance, PTT/another polyester, and PTT/PTT.

Also, the PTT composite fiber according to the present invention satisfies the following conditions:

(1) the content of trimethylene terephthalate cyclic dimer in PTT is 2.5 wt % or less, (2) the fiber-fiber dynamic friction coefficient is in a range from 0.2 to 0.4, (3) the degree of intermingling is in a range from 2 to 60 point/m and/or the number of twists is in a range from 2 to 60 T/m, and (4) The fiber size fluctuation U% is 1.5% or less.

The above-mentioned conditions (1) to (3) are important for solving the problems I to III, and the condition (4) is important for solving the problem III.

The explanation will be made of these conditions below.

The content of trimethylene terephthalate cyclic dimer in the PTT used for the present invention is 2.5 wt % or less, preferably 2.2 wt % or less, more preferably 1.1 wt % or less, further more preferably 1.0 wt % and most preferably none. In this regard, the content of trimethylene terephthalate cyclic dimer is a measured value which is analyzed by a $^1$H-NMR method described later.

When the content of trimethylene terephthalate cyclic dimer is within the above-mentioned range, there is no deposition of white powder on guides or the like during the knitting/weaving process, which results in a stable knitting/weaving operation free from the generation of yarn breakages or fluffs. Also, no dyeing problems are generated, caused by the deposition of cyclic dimer during dyeing process. Particularly, to avoid the dyeing abnormality in the cheese dyeing process, the content of trimethylene terephthalate cyclic dimer is preferably 2.2 wt % or less, more preferably 1.8 wt % or less.

In the present invention, the PTT is preferably PTT homopolymer or PTT coplymer containing repeated units of 90 mol % or more of trimethylene terephthalate and 10 mol % or less of another ester.

Representative examples of the copolymerized component are as follows:

As acidic components, there are aromatic dicarbonic acids such as isophthalic acid or 5-sodium sulfoisophthalate and aliphatic dicarbonic acids such as adipic acid or itaconic acid. Also, hydroxycarbonic acid such as hydroxybenzoic acid is cited as an example. As a glycol component, there are ethylene glycol, butylene glycol and polyethylene glycol, which may be copolymerized to each other.

The PTT used for the present invention may be produced by a known process. For example, it may be produced by a single-step method in which a desired final degree of polymerization is obtained solely by the melt-polymerization, or by a two-step method in which a certain degree of polymerization is obtained by the melt-polymerization and then a desired final degree of polymerization is reached by a solid phase polymerization. The latter two-step method, in which the solid phase polymerization is combined, is preferable for the purpose of decreasing the content of cyclic dimer. In this regard, the PTT produced by the single-step method is preferably subjected to the extraction treatment or others prior to being fed to the spinning process so that an amount of trimethylene terephthalate cyclic dimer is reduced.

According to the present invention, as another polyester component for constituting the single filament, the above mentioned PTT, PET, polybutylene terephthalate (hereinafter referred to as PBT) and copolymers thereof copolymerized with a third component are favorably used other than the above-mentioned PTT.

The representative third components are as follows:

As an acidic component, there are aromatic dicarbonic acid such as isophthalic acid or 5-sodium sulfoisophthalate and aliphatic dicarbonic acid such as adipic acid or itaconic acid. Also, hydroxycarbonic acid such as hydroxybenzoic acid is cited as an example. As a glycol component, there are ethylene glycol, butylene glycol and polyethylene glycol, which may be copolymerized to each other.

The PTT composite fiber according to the present invention preferably has a fiber-fiber dynamic friction coefficient in a range from 0.2 to 0.4, more preferably from 0.3 to 0.4.

If the fiber-fiber dynamic friction coefficient is in the above range, when the composite fiber is taken up as a package of a pirn or cheese form, the package shape can be maintained in a stable state during the winding operation. Also, since no white powder is generated in the knitting/weaving process, a fabric can be formed in a stable state.

The PTT composite fiber according to the present invention has a degree of intermingling in a range from 2 to 60 point/m, preferably from 5 to 50 point/m, or a number of twists in a range from 2 to 60 T/m, preferably from 5 to 50 T/m.

If the degree of intermingling and/or the number of twists are within the above range, the single filaments of the composite fiber are not separated from each other, whereby the knitting/weaving operation can be carried out without the generation of yarn breakages or fluffs, which results in the sufficient strength at break and the excellent stretchability as well as the favorable post-treatment processibility. The larger the degree of intermingling and/or the number of twists, the more favorable the processibility in the knitting/weaving process. However, if the degree of intermingling and/or the number of twists is too large, the strength at break of the PTT composite fiber is liable to decrease. Also, if the number of twists is too large, the development of crimps is liable to be suppressed to lower the stretchability.

To suppress the yarn breakage caused by the intermingling of single filaments during the warp knitting (tricot knitting) operation and ensure the favorable knitting capability, it is desired that not only the number of twists is in a range from 10 to 35 T/m but also the degree of intermingling is in a range from 10 to 35 point/m.

The PTT composite fiber according to the present invention has the fiber size fluctuation U% of 1.5% or less, preferably 1.2% or less, more preferably 1.0% or less. If the fiber size fluctuation U% is 1.5% or less, a dyed fabric having a favorable dyeing grade is obtained. In this regard, the fiber size fluctuation U% is measured by an evenness tester described later.

In the present invention, the PTT composite fiber preferably has an average intrinsic viscosity in a range from 0.7 to 1.2 dl/g, more preferably from 0.8 to 1.2 dl/g.

If the average intrinsic viscosity is within the above range, the strength of the composite fiber becomes high and a fabric having high mechanical strength is obtained. Such a fabric is suitable for a sports use needing the high strength. The composite fiber can be produced in a stable state without the generation of yarn breakages.

In the present invention, both of the two components constituting the single filament are preferably PTT because an excellent stretchback property is exhibited. When both the components are PTT, the content of trimethylene terephthalate cyclic dimer in the respective component is preferably 1.1 wt % or less for the purpose of reducing the content of cyclic dimer in the composite fiber.

Also, the difference in intrinsic viscosity between both the components is more preferably in a range from 0.1 to 0.4 dl/g and the average intrinsic viscosity is more preferably from 0.8 to 1.2 dl/g. If the difference in intrinsic viscosity is within the above range, crimps are sufficiently developed to result in an excellent stretchback property, and the PTT composite fiber lower in fiber size fluctuation is obtained, which is free from yarn bending and contamination of spinning orifice during the extrusion. The difference in intrinsic viscosity is more preferably in a range from 0.15 to 0.30 dl/g.

According to the present invention, a ratio (weight ratio) between the two kinds of polyesters different in intrinsic viscosity in the cross-section of a single filament is preferably in a range from 40/60 to 70/30 between higher and lower viscosity components and, more preferably, from 45/55 to 65/35. If the ratio between the higher and lower viscosity components is within the above range, the resultant PTT composite fiber is excellent in crimpability and has a strength as high as 2.5 cN/dtex or more, from which is obtainable a fabric having a large tear strength.

In the composite fiber according to the present invention consisting of a group of single filaments, in each of which the two kinds of polyester components are laminated to each other in a side-by-side manner, a radius of curvature r (am) of a boundary of the two components in the cross-section of the single filament is preferably 10 $d^{0.5}$ or less, more preferably in a range from 4 $d^{0.5}$ to 9 $d^{0.5}$, wherein d represents a single filament size (decitex).

The PTT composite fiber according to the present invention preferably has a maximum elongation of developed crimps of 50% or more, more preferably 100% or more. The developed crimp is an important factor for realizing the excellent stretchability and stretchback property. While the maximum crimp elongation is preferably as high as possible, approximately 300% would be the upper limit according to the present technology.

The maximum crimp elongation is an elongation of a crimp portion obtained by the measurement described later, which stands for the elongation value at which the crimps are completely stretched in the fiber as shown, for example, in a stress-strain curve of FIG. 3. In FIG. 3, the curve is divided into an area (X) in which the crimp portion is solely stretched and an area (Y) in which the fiber body is stretched. The maximum crimp elongation is defined by a value at which the elongation of the crimp portion has finished and the stretching of the fiber body starts (a point A in FIG. 3).

The PTT composite fiber according to the present invention is different from the conventional side-by-side type composite fiber in that crimps are apparently developed prior to being treated with boiling water. Contrarily, the conventional composite fiber of a latent crimp type exhibits crimps after being treated with boiling water. Also, while the number of crimps in the conventional false-twist textured yarn increases by the boiling water treatment, the crimps already existed as developed crimps prior to being treated with boiling water. According to the measurement carried out by the present inventors, the developed crimps in the false-twist textured yarn has a maximum crimp elongation in a range from about 20 to 30%.

That is, it will be understood that the PTT composite fiber according to the present invention has developed crimps as good as those of the false-twist textured yarn.

It is assumed that, due to the existence of such developed crimps, the excellent stretchability and stretchback property are ensured.

In this regard, the reasons why the PTT composite fiber of the present invention exhibits excellent developed crimpability resides in the characteristic of the inventive production method in which the spinning operation is carried out while using a special spinning orifice under a special spinning condition, as described later.

The PTT composite fiber according to the present invention preferably has a maximum crimp elongation, after being treated with boiling water, of 100% or more, more preferably 150% or more, further more preferably 200% or more, and the crimp stretch recovery speed after the maximum crimp stress has been applied is preferably 15 m/sec or more. In this regard, although it is preferable that the maximum crimp elongation after being treated with boiling water and the crimp stretch recovery speed after the maximum crimp stress are as large as possible, approximately 600% and 40 m/sec would be the upper limits, respectively, according to the present technology.

The maximum crimp elongation after being treated with boiling water is an index for guaranteeing the stretchability of the fabric, and the larger this value, the better the fabric stretchability.

The crimp stretch recovery speed after the maximum crimp stress is applied is an index for guaranteeing the stretchback property the fabric, which is an elongation recovery speed after a stress corresponding to a point A in the stress-strain curve of the crimped multifilamentary yarn shown in FIG. 3 is applied to the fiber. That is, the stretchback property is defined by the recovery speed of the stretched fabric by which the fabric returns to the original length immediately after a stress applied to the fabric for stretching the same is released. Thus, it could be said that the faster the stretch recovery speed, the more excellent the stretchback property. The present inventors could for the first time measure this stretch recovery speed by a high-speed video camera method described later.

The PTT composite fiber according to the present invention preferably has the stretch recovery speed of 15 m/sec or more, more preferably 20 m/sec or more. It could be said that a fiber having the stretch recovery speed of 25 m/sec or more is equal to spandex (polyurethane type elastomeric fiber) in high stretchback property.

In the measurement of dry heat shrinkage stress, the PTT composite fiber according to the present invention preferably has the starting temperature of stress development at 50° C. or higher and the shrinkage stress at 100° C. of 0.1 cN/dtex or more.

The starting temperature of dry heat shrinkage stress development is defined by a temperature at which the development of the shrinkage stress is started in the measurement of the dry heat shrinkage stress described later. If the starting temperature of stress development is 50° C. or higher, the developed crimpability is not lowered even though the composite fiber is stocked for a long period in a pirn form or a package form wound on a bobbin, because the developed crimps in the composite fiber are not relaxed. While the starting temperature of stress development is preferably as high as possible, for example, 60° C. or higher, approximately 90° C. would be the upper limit according to the present technology.

In the present invention, in addition to the above-defined starting temperature of stress development, the shrinkage stress at 100° C. is preferably 0.1 cN/dtex or more. The shrinkage stress at 100° C. is an important factor for crimps to be developed in the post-treatment of the fabric such as a scouring process, wherein, if this value is 0.1 cN/dtex or more, it is possible to sufficiently develop crimps while overcoming the constraint of the fabric. The shrinkage stress at 100° C. is more preferably 0.15 cN/dtex or more, approximately 0.3 cN/dtex would be the upper limit according to the present technology.

The PTT composite fiber according to the present invention preferably has the elongation at break in a range from 30 to 50%, more preferably from 35 to 45%.

The elongation at break is an important factor for realizing the stability of the knitting/weaving process and facilitating the stretch recovery of the fabric. If the elongation at break is within the above range, the stretch recovery is good and no yarn breakage or fluff generates in the spinning process of the composite fibers as well as in the knitting/weaving process, whereby the process stability is maintained to result in a fabric large in maximum crimp elongation of developed crimps and excellent in stretchability and stretchback property.

The PTT composite fiber according to the present invention preferably has the strength at break of 2.5 cN/dtex or more, more preferably 2.6 cN/dtex or more. If the strength at break is 2.5 cN/dtex or more, no fluff or yarn breakage, caused by the contact of the fibers with guides or others during the knitting/weaving, occurs. In this regard, while the strength at break is preferably as high as possible, approximately 4.0 cN/dtex would be the upper limit according to the present technology.

The PTT composite fiber according to the present invention preferably has a winding hardness in a range from 80 to 90 when wound in a pirn form, more preferably from 85 to 90.

The winding hardness is an important factor for maintaining developed crimps even if the fibers are stocked in a long period. It will be apparent that the winding hardness of the pirn of the drawn PTT composite fibers according to the present invention is much lower than that of the conventional PET fibers which is usually 90 or higher. If the winding hardness is within the above range, the pirn is not deformed by the handling during the transportation and the yarn quality is maintained unchanged over a long stocking period, whereby the developed crimps, which are the characteristic of the present invention, are retained.

A total yarn size and a single filament size of the PTT composite fibers are not limited, but the total yarn size is preferably in a range from 20 to 300 dtex, and the single filament size is preferably in a range from 0.5 to 20 dtex.

The cross-sectional shape of the single filament is not limited and may include a circle, a non-circle such as a Y-shape or a W-shape, or a hollow shape.

Additives may be contained in or copolymerized with the PTT composite fiber according to the present invention unless they would disturb the effects of the present invention, such as delusterant, for example, titanium oxide, a heat stabilizer, an antioxidant, an antistatic agent, an ultraviolet light absorber, an anti-fungal agent or various pigments may be added.

A method for producing the PTT composite fiber according to the present invention will be described below.

The PTT composite fiber according to the present invention can be produced by using the conventional composite fiber producing apparatus provided with a twin-screw extruder, except for a spinneret described hereinafter.

One example of the composite fiber producing apparatus used for carrying out the method of the present invention is illustrated in the drawings wherein FIG. 5 is the schematic illustration of a spinning apparatus and FIG. 6 is of a draw twister.

Based on FIGS. 5 and 6, one embodiment of the method for producing the PTT composite fiber according to the present invention will be described below.

First, pellets of PTT, which is one of the polyester components, are dried by a drier 1 to have a moisture content of 20 ppm or lower and fed to an extruder 2 set at a temperature in a range from 240 to 280° C. to be melted. The other of the polyester components is similarly dried in a drier 3 and fed to an extruder 4 to be melted.

The melted PTT and the other polyester are fed, via bends 5 and 6, respectively, to a spin head 7 set at a temperature in a range from 240 to 280° C. and weighed by gear pumps, respectively. Thereafter, the two components flow together in a spinneret 9 having a plurality of spinning orifices and mounted to a spin pack 8 and are laminated to each other in a side-by-side manner to be a multifilamentary yarn 10 which is extruded in a spinning chamber.

After passing through a non-air blowing region 11, the multifilamentary yarn 10 extruded into a spinning chamber is cooled to a room temperature and solidified by cooling air 12 and wound as a package 15 of an undrawn yarn having a predetermined fiber size by takeup godet rolls 13 and 14 rotated at a predetermined speed.

The undrawn yarn 15 is imparted with finishing agent by a finishing agent application device 16 prior to being in contact with the takeup godet roll 13. The finishing agent is preferably an aqueous emulsion type having a concentration of preferably 15 wt % or more, more preferably in a range from 20 to 35 wt %.

In the production of the undrawn yarn, the winding speed is preferably 3000 m/min or less, more preferably from 1000 to 2000 m/min, further more preferably from 1100 to 1800 m/min.

The undrawn yarn is then supplied to a drawing process in which it is drawn by a draw twister as shown in FIG. 6. Before the undrawn yarn is supplied to the drawing process, it is preferably maintained in an environment of an atmospheric temperature in a range from 10 to 25° C. and a relative humidity in a range from 75 to 100%. The undrawn yarn on the draw twister is preferably maintained at this temperature and this relative humidity throughout the drawing operation.

On the draw twister, the undrawn yarn package 15 is first heated on a supply roll 17 set at a temperature preferably in a range from 45 to 65° C. The temperature of the supply roll is more preferably in a range from 50 to 60° C., further more preferably from 52 to 58° C. Then, it is drawn to have a predetermined fiber size by using the difference in peripheral speed between the supply roll 17 and a draw roll 20. The yarn runs while being in contact with a hot plate 19 heated at a temperature in a range from 100 to 150° C. after or during the drawing so that it is subjected to a heat treatment under tension. The yarn exiting the draw roll is wound on a bobbin as a drawn yarn pirn 22 while being twisted by a spindle traveller 21.

If necessary, a drawing pin 18 may be provided between the draw roll 17 and the hot plate 19 to assist the drawing. In such a case, it is desirable that a temperature of the draw roll is strictly controlled to be preferably in a range from 50 to 60° C., more preferably from 52 to 58° C.

In the inventive production method, a melt-spinning temperature of PTT is in a range from 240 to 280° C. and a melting time is within 20 minutes.

Under such conditions, the content of trimethylene terephthalate cyclic dimer contained in the PTT composite fiber becomes 2.5 wt % or less, whereby the object of the present invention is achievable. The present inventors have found that an amount of trimethylene terephthalate cyclic dimer contained in PTT increases during the melt-spinning process, which is avoidable by controlling the melt-spinning conditions in a special range.

To further reduce the content of trimethylene terephthalate cyclic dimer, the melt-spinning temperature is preferably in a range from 250 to 270° C.

The melting time of PTT is preferably as short as possible, that is, within 15,minutes in the industrial sense, however, the lower limit of the melting time would be approximately 5 minutes under the present technology.

If both the polyester components are PTT, the melt-spinning temperature is preferably in a range from 255 to 270° C., more preferably from 255 to 265° C. and the melting time is preferably within 20 minutes, more preferably within 15 minutes, whereby it is possible to suppress the content of trimethylene terephthalate cyclic dimer contained in the PTT composite fiber to 2.0% or less.

In the inventive production method, a special spinneret is preferably used. One example of a favorable spinneret is shown in FIG. 4.

In FIG. 4, (a) denotes a distribution plate and (b) denotes a special spinneret. Two kinds of polyester components or PTT A and B different in intrinsic viscosity are supplied from the distribution plate (a) to the spinneret (b).

After the both are joined in the spinneret (b), they are extruded from the spinning orifice having the inclination of θ degrees relative to the vertical direction. A diameter of the spinning orifice is D and a length thereof is L.

According to the present invention, a ratio (L/D) between the orifice diameter D and the orifice length L is preferably 2 or more. If L/D is 2 or more, after both the components are joined together, the laminated state thereof becomes stable and the fiber size fluctuation caused by the difference in melting viscosity between the two polymers does not occur when extruded from the orifice, whereby the fiber size fluctuation U% can be maintained in a range defined by the present invention. While L/D is preferably as large as possible, practically, it is preferably from 2 to 8, more preferably from 2.5 to 5 in view of the ease of machining the orifice.

The spinning orifice of the spinneret used for the present invention preferably has an inclination relative to the vertical direction in a range from 10 to 40 degrees. This inclination of the orifice relative to the vertical direction is shown in FIG. 4 by an angle θ.

The inclination of the orifice relative to the vertical direction is an important factor for restricting the yarn bending occurring during extruding the two kinds of polyesters due to the difference in melting viscosity of polymer.

In a case of the conventional spinneret with an orifice having no inclination, if two PTTs having the difference in melting viscosity are combined, for example, the resultant filament is liable to bend directly after the extrusion toward the component having a higher melting viscosity, which is called a "bending phenomenon", to disturb the stable spinning.

In the orifice shown in FIG. 4, preferably, the polymer having a higher melting viscosity is fed to A and that having a lower melting viscosity is fed to B.

For example, if the difference in intrinsic viscosity is about 0.1 or more between the two kinds of PTT, the inclination of the orifice relative to the vertical direction is preferably at least 10 degrees for the purpose of realizing the stable spinning free from the yarn bending. If the difference in intrinsic viscosity between the two polymers is even larger, the inclination is preferably even larger. However, if the inclination is too large, an extrusion opening becomes oval to disturb the stable spinning, and also the machining of the orifice itself becomes difficult, whereby the upper limit is approximately 40 degrees.

The inclination is preferably in a range from 15 to 35 degrees, more preferably from 20 to 30 degrees according to the present invention.

In the present invention, the combination of the inclination in a range from 15 to 35 degrees with the ratio between orifice diameter and length (L/D) of 2 or more furthermore facilitates the extrusion stability.

In the production method according to the present invention, a condition for the extrusion after the two kinds of polyesters are joined together by using the above-mentioned spinneret is defined so that the product of an average intrinsic viscosity [η] (dl/g) and an extrusion linear speed V (m/min) is in a range from 3 to 15 (dl/g)·(m/min), preferably from 5 to 10 (dl/g)·(m/min).

This extrusion condition is an important factor for preventing the spinning orifice from being contaminated by the "eye mucus" deposited on the periphery of the orifice due to long term spinning, to minimize the fiber size fluctuation U% to within the range defined by the present invention.

If the product of the average intrinsic viscosity and the extrusion linear speed is smaller than the lower limit, a ratio between the extrusion speed and the winding speed becomes excessively large, whereby the fiber size fluctuation is liable to exceed 1.5%, while the contamination of the spinning orifice is reduced. Contrarily, if the product of the average intrinsic viscosity and the extrusion linear speed is larger than the upper limit, the contamination of the spinning orifice increases to be liable to disturb the stable continuous production.

In the production method according to the present invention, the multifilamentary yarn extruded from the spinneret is cooled and solidified to a room temperature by cool air after passing through a non-air blowing region having a length in a range from 50 to 250 mm, and then preferably drawn under a drawing stress in a range from 0.1 to 0.4 cN/dtex.

By providing the non-air blowing region in the above-mentioned range, the adhesion of the two kinds of polyesters different in intrinsic viscosity becomes better, whereby the orientation of the component having the higher intrinsic viscosity is particularly restricted to result in a PTT composite fiber having a high developed crimpability, a high strength and a small fiber size fluctuation U%.

If the length of the non-air blowing region is too short, the orientation is not sufficiently restricted. On the contrary, if it is too long, the orientation is excessively restricted, whereby the yarn fluctuation becomes larger to increase the fiber size fluctuation. A preferable range of the non-air blowing region is in a range from 100 to 200 mm.

According to the inventive production method, the cooled and solidified multifilamentary yarn is imparted with a finishing agent containing fatty acid ester and/or mineral oil in a range from 10 to 80 wt % or that containing polyether having a 1000 to 20000 molecular weight in a range from 50 to 98% at a ratio in a range from 0.3 to 1.5 wt %, preferably from 0.5 to 1.0 wt % relative to the fiber. By applying such an agent, it is possible to make the fiber-fiber dynamic friction coefficient of the PTT composite fiber to be in a range from 0.2 to 0.4.

If the ratio of fatty acid ester and/or mineral oil is too small, the fiber-fiber dynamic friction coefficient exceeds 0.4, whereby the object of the present invention is not achievable. Contrarily, if this ratio is too large, there are various troubles due to the generation of static electricity, such as the separation of single filaments in the yarn during the treatment thereof.

If the molecular weight of the polyether is too small, the fiber-fiber dynamic friction coefficient exceeds 0.4, whereby the object of the present invention is not achievable. Contrarily, if it is too large, there occur some troubles such that the polyether is separated out and deposited during the post-treatment. The molecular weight is preferably in a range from 2,000 to 10,000.

If the content of polyether is too small, it is difficult to control the fiber-fiber dynamic friction coefficient at 0.4 or less. The content is preferably in a range from 60 to 80 wt %.

In the inventive production method, the composite fiber is interlaced and/or twisted with each other at any of the stages before the final winding process. The interlace may be imparted, for example, at a stage between the application of finishing agent and the winding of undrawn yarn package in FIG. 5. Also, in FIG. 6, an interlace device 23 may be provided next to the draw roll 20.

The interlace device 23 may be, for example, a conventional interlacer.

It is possible to obtain a predetermined number of twists by properly selecting a ratio between the peripheral speed of the draw roll 20 and the rotational speed of the pirn in FIG. 6.

In the inventive production method, when the undrawn yarn is drawn, the drawing stress is preferably in a range from 0.1 to 0.4 cN/dtex, more preferably from 0.15 to 0.35 cN/dtex. The drawing stress is an effective factor for developing the crimps of the PTT composite fibers.

If the drawing stress is too small, the crimps are not sufficiently developed, while if it is too large, the yarn breakages or fluffs may generates during the drawing operation to disturb the stable production.

A proper drawing stress is obtainable in accordance with smoothness, drawing ratio, drawing temperature and heat-treatment temperature.

When the drawn PTT composite fiber yarn is wound in a pirn form, a ballooning tension is preferably in a range from 0.03 to 0.15 cN/dtex, more preferably from 0.05 to 0.10 cN/dtex.

The ballooning tension is an important factor for maintaining the crimp characteristic of the PTT composite fiber yarn in a stable state even if it is stocked for a longer period.

If the ballooning tension is too large, the pirn hardness exceeds 90 as well as the developed crimpability is liable to lower while being stocked for a long period. On the contrary, if it is too small, the pirn hardness becomes less than 80 to cause problems such as the deformation of pirn during the transportation thereof.

In the present invention, a so-called two-step method is favorably employed, in which melted polymer extruded from the spinneret is cooled and solidified, and an undrawn yarn is wound up as a package. The undrawn yarn is then drawn to be a drawn yarn in the drawing process. Care must be taken when this undrawn yarn package is stocked so that the moisture content in the undrawn yarn and the storage temperature is maintained at a proper level. If the moisture content of the undrawn yarn is high or the storage temperature is high, a periodical fiber size fluctuation may occur in the undrawn yarn wound in the vicinity of the end surface of the package, whereby there is a risk in that the fiber size fluctuation U% may exceed 1.5%. The moisture content of the undrawn yarn is preferably 2 wt % or less, more preferably 1 wt % or less. The storage temperature is preferably 25° C. or lower, more preferably 22° C. or lower.

In the inventive production method, a direct spin-draw method may be adopted, in which the spinning and the drawing are continuously carried out, provided the object of the present invention is achievable. In the direct spin-draw method, the filamentary yarn is not once wound as an undrawn yarn package but continuously drawn into a drawn yarn. Also in this drawing, the drawing stress is preferably in a range from 0.2 to 0.4 cN/dtex.

When the drawn yarn is wound as a cheese-shaped package, the winding tension is preferably in a range from 0.03 to 0.15 cN/dtex.

The inventive PTT composite fiber yarn may be knit or woven as it is to form a fabric which has a good quality free from uneven dyeing and is excellent in stretchability and stretchback property.

Also, the inventive PTT composite fiber may be subjected to a post-treatment such as a false-twist texturing, a twisting or a taslan texturing to result in a favorably processed yarn.

Further, the inventive PTT composite fiber may be A cut into staple fibers.

The inventive PTT composite fiber may be used alone or mixed with other fibers; in either case, the effects of the present invention could be exhibited.

The other fibers mixed therewith may be chemical or synthetic fibers such as other polyester fiber, nylon fiber, acrylic fiber, cuprammonium rayon fiber, viscose rayon fiber, acetate fiber or polyurethane elastomeric fiber; and natural fibers such as cotton, ramie, silk or wool, but not limited thereto. Also, the fibers to be mixed may be either filament or staple.

The mixing method includes a mixed twisting, a mixed weaving or an interlacing. In a case of staple, both the fibers may be mixed in a carding process.

BEST MODE FOR CARRYING OUT THE INVENTION

Figure 1:
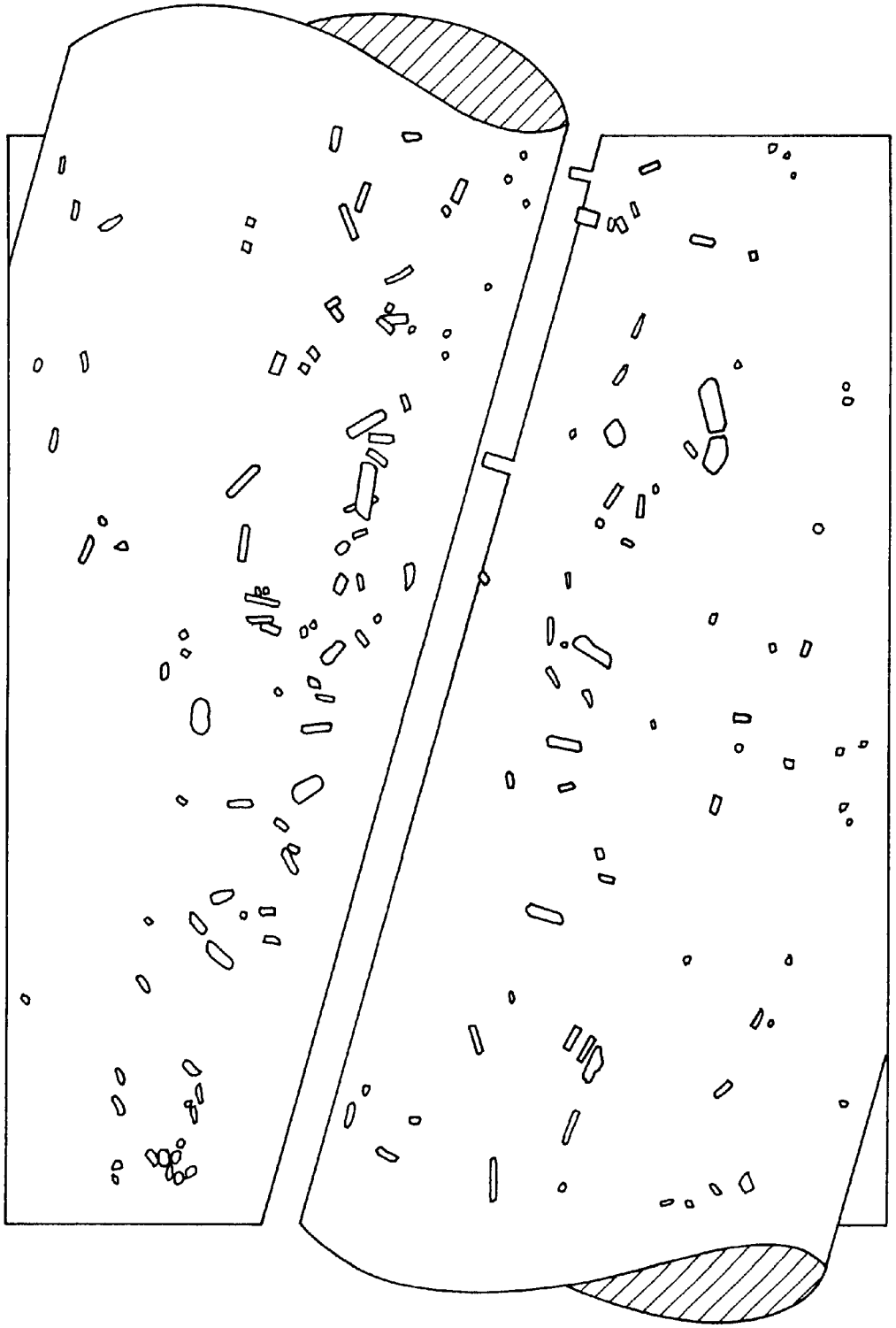
FIG. 1 is a schematic illustration depicting a scanning electron microscopic photograph of a surface of PTT composite fiber which has been heat-set after the twisting process.
Figure 2:
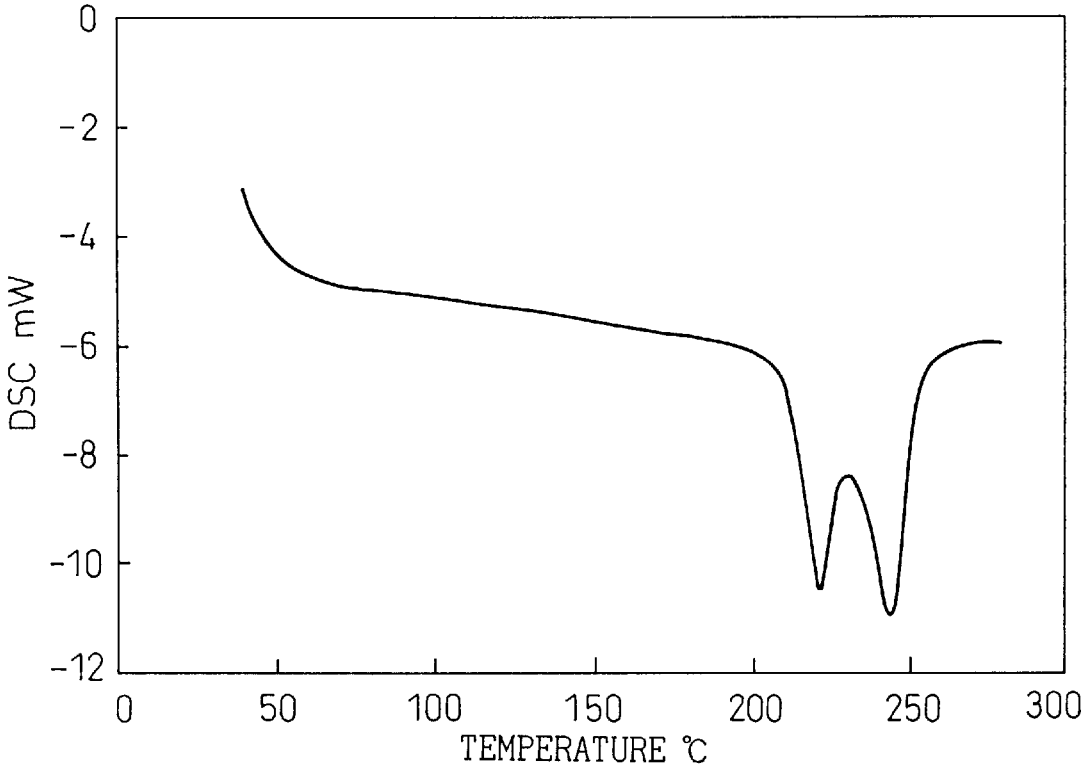
FIG. 2 is one example of a chart obtained by the differential scanning calorimetric measurement (DSC) of white powder deposited on a loom.

The present invention will be described below in more detail with reference to the preferred embodiments, but should not limited thereto.

In this regard, the measurements and the evaluation methods are as follows:

(1) Intrinsic viscosity

The intrinsic viscosity [η] (dl/g) is a value defined by the following equation:

$$[\eta]=Lim\ (\eta r-1)/C$$

$c \rightarrow 0$

In the equation, ηr is a value obtained by dividing a viscosity of diluted solution of PTT at 35° C. dissolved with o-chlorophenol solvent having a purity of 98% or more by a viscosity of the solvent at the same temperature, which is defined as a relative viscosity. C is a concentration of polymer represented by g/100 ml.

(2) Content of trimethylene terephthalate cyclic dimer

The content of trimethylene terephthalate cyclic dimer was measured by a $^1$H-NMR method. A measuring device and measurement conditions are as follows:

Measuring device: FT-NMR DPX-400 manufactured by Bruker Co.

Solvent: trifluoroacetic acid heavy hydride

Concentration of sample: 2.0 wt %

Measurement temperature: 25° C.

Chemical shift base: Tetramethylsilane (TMS) is 0 ppm.

Integration number: 256

Waiting time: 3.0 sec.

After scoured with water, the fiber was dried at a room temperature for 24 hours to prepare a sample which was then subjected to the measurement of $^1$H-NMR spectrum.

By using signals derived from benzene ring of trimethylene terephthalate cyclic dimer, the content of trimethylene terephthalate cyclic dimer was determined by a ratio of the integrated value of the former to that of signals derived from benzene ring of PTT and/or another polyester.

The measurements were repeated three times per one sample and an average value thereof was obtained.

(3) Fiber-fiber dynamic friction coefficient

A fiber yarn of 690 m long was wound around a cylinder of 5.1 cm diameter and 7.6 cm long at a winding angle of 15 degrees with a tension of about 15 g. Next, the same kind of fiber yarn of 30.5 cm hung on this cylinder so that the yarn is vertical to the cylinder axis.

A weight (g) corresponding to 0.04 times a total fiber size of the yarn hanging on the cylinder was fixed to one end of the yarn hanging on the cylinder, and a strain gauge was connected to the other end of the yarn.

Then, a tension was measured by the strain gauge while rotating the cylinder at a peripheral speed of 18 m/min. Based on the tension thus measured, a fiber-fiber dynamic friction coefficient f was determined by the following equation. The measurement is carried out at 25° C.

$$f=(1/\pi)\times\ln\ (T_2/T_1)$$

wherein $T_1$ is a weight (g) applied to the yarn, $T_2$ is an average tension (g) measured at least 25 times, ln is a natural logarithm and $\pi$ is the ratio of circumference of a circle to its diameter.

(4) Degree of entanglement

A degree of entanglement was measured in accordance with JIS-L-1013.

(5) Fiber size fluctuation U%

A fiber size fluctuation chart (a graph; Diagram Mass) was obtained by the following method and U% was simultaneously measured:

Measuring device: evenness tester (USTER TESTER UT-3 manufactured by Zellweger Uster Co.)

Yarn speed: 100 m/min

Disk tension force: 12.5%

Setting of tension: 1.0 (input value)

Entry pressure: 2.5 hp

Twist: z 1.5 (dial)

Measured yarn length: 250 m/min

Scale: determined in accordance with the fiber size fluctuation

The fiber size fluctuation U% was measured by directly reading the fluctuation chart and the fluctuation value displayed.

(6) Strength at break, elongation at break and maximum crimp elongation

A strength at break, elongation at break and maximum crimp elongation were measured in accordance with JIS-L-1013.

The maximum crimp elongation of developed crimps was measured by using a sample of the composite fiber in a hank form prepared from a pirn, which is left in an atmosphere at a temperature of 20±2° C. and a relative humidity of 65±2% in a non-loaded state for 24 hours.

Figure 3:
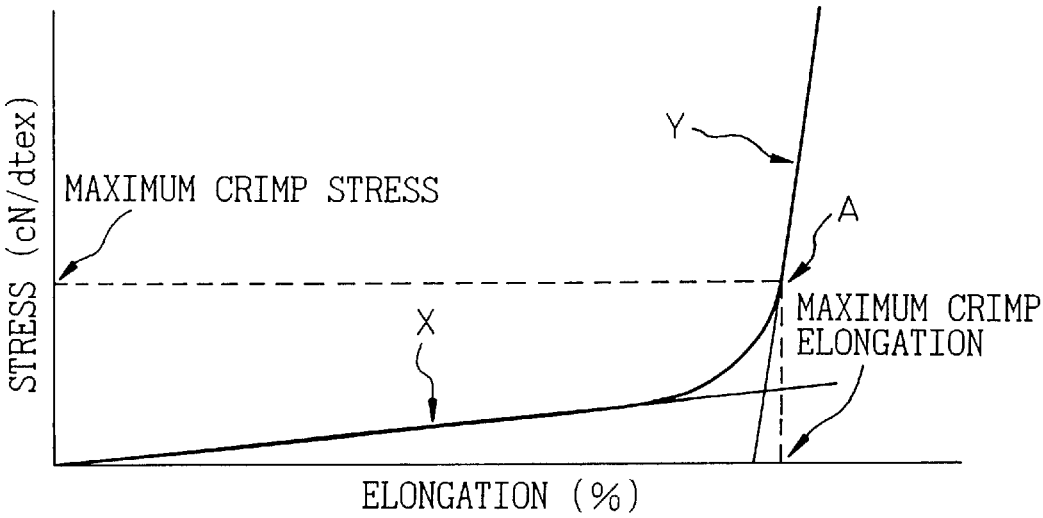
FIG. 3 is one example of a stress-strain curve of the PTT composite fiber according to the present invention.
Figure 4:
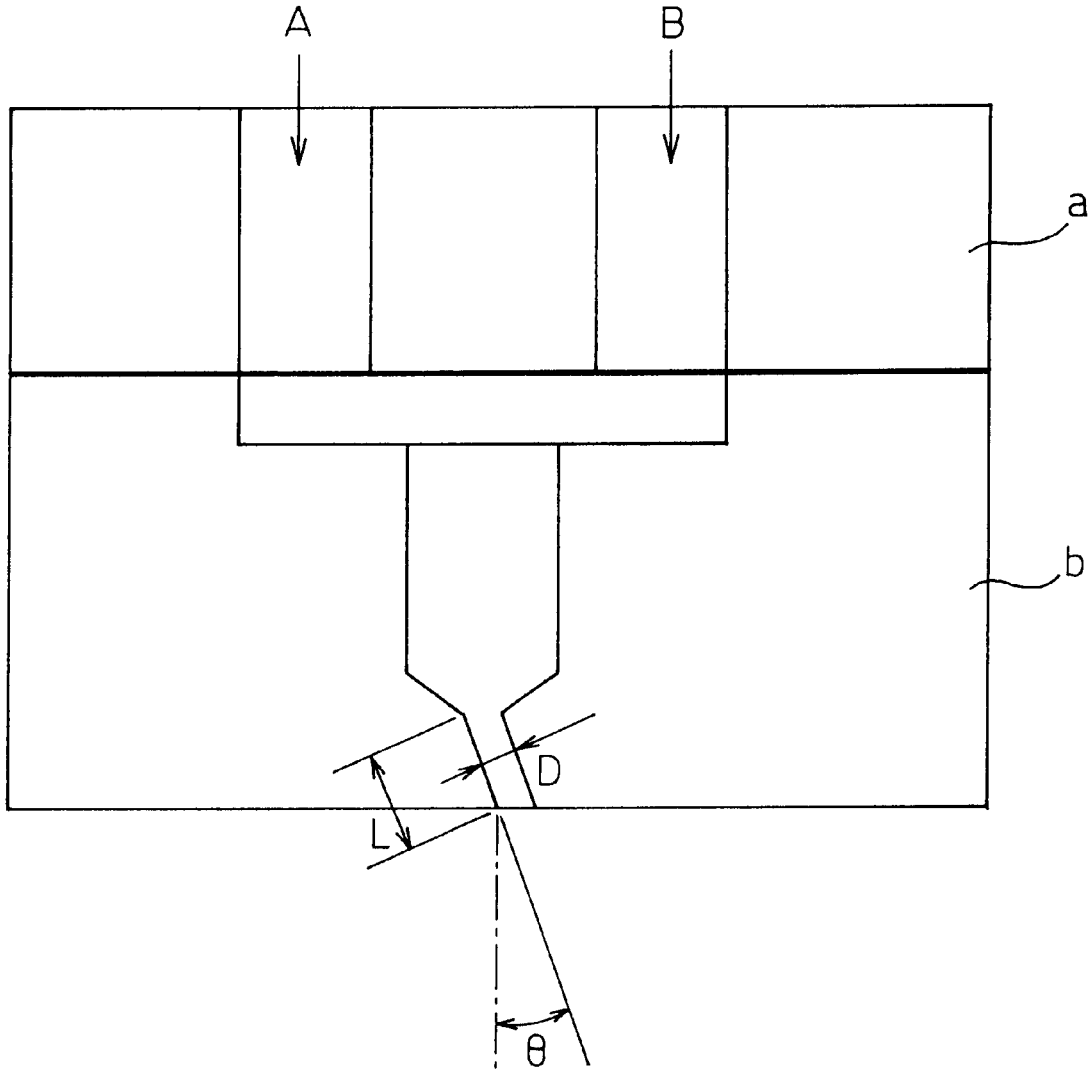
FIG. 4 is a schematic illustration of one example of a spinning orifice of a spinneret used for the inventive production method.
Figure 5:
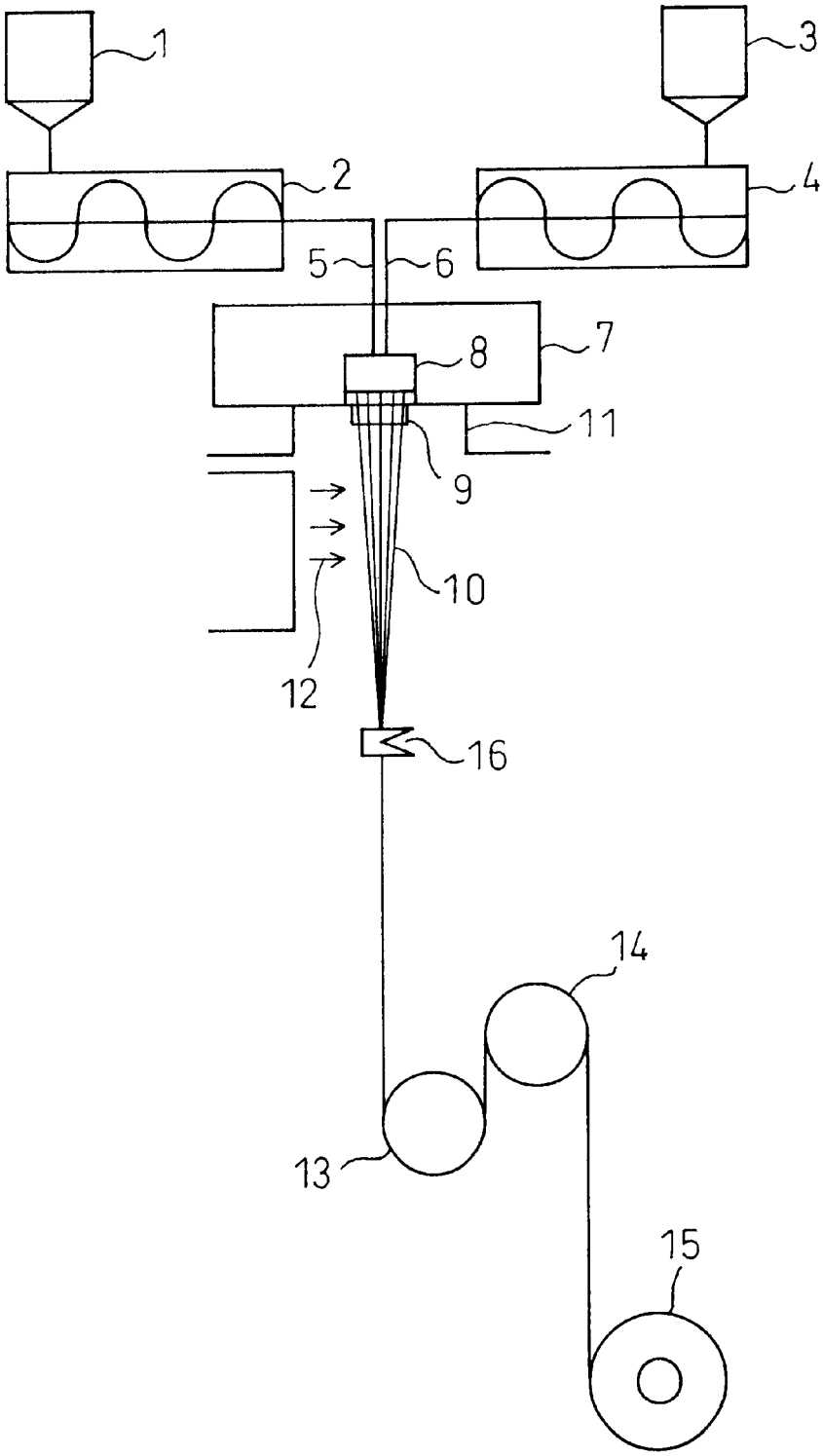
FIG. 5 is a schematic illustration of an example of a spinning apparatus used for the inventive production method.

The maximum crimp elongation was defined from a stress-strain curve obtained by a tensile tester after applying an initial load of $0.9\times10^{-3}$ cN/dtex to the composite fiber. For example, as shown in FIG. 3, a point A at which the crimps are completely stretched was determined from the stress-strain curve and the elongation at this point was defined as the maximum crimp elongation.

A maximum crimp elongation after being treated with boiling water was measured by using the same sample as stated above, which is immersed in boiling water at 98° C. for 20 minutes and naturally dried for 24 hours with no load. In the same manner as above, an initial load of $0.9\times10^{-3}$ cN/dtex was applied to this sample and the measurement was carried out.

(7) Elongation recovery speed

The following measurement was carried out in accordance with JIS-L-1013.

In the same manner as the measurement of the maximum crimp elongation after being treated with boiling water, the crimped composite multifilamentary yarn was stretched to the point A on the stress-strain curve shown in FIG. 3 by a tensile tester.

The stretched sample was maintained at the point A for 3 minutes and cut by scissors directly above a lower nip point.

A speed shrinkage of the composite fiber yarn cut by the scissors was observed on a picture taken by a high-speed video camera (resolution: 1/1000 sec). A mm-scale rule was fixed at a distance of 10 mm from the composite fiber yarn in a side-by-side manner, and a tip end of the cut composite fiber yarn is focussed so that the recovery of the composite fiber yarn can be observed. The picture taken by the high-speed video camera was played back so that the movement per unit time (mm/ms) of the tip end of the composite fiber yarn is read, from which the recovery speed (m/sec) was determined.

(8) Dry heat shrinkage stress

A thermal stress measuring device (for example, KE-2 manufactured by KANEBO ENGINEERING K.K.) was used under the condition defined by JIS-L-1013.

A 20 cm length piece of a drawn yarn was taken from a pirn or a cheese, and both ends thereof were tied together to form a loop which was loaded in the measuring device. The measurement was carried out at an initial load of 0.044 cN/dtex and at a temperature-rising rate of 100° C./min, and a dry-heat shrinkage stress with time was depicted in a chart.

From the chart obtained by the measurement, a temperature at which the heat shrinkage development A begins was defined. The heat shrinkage stress follows a curve having a peak in a high temperature region. From this curve, a stress at 100° C. was read to define a shrinkage force at 100° C.

(9) Winding hardness

A harness of a drawn yarn pirn was measured by a hardness tester GC type-A manufactured by Techlock (phonetic) K.K. in such a manner that a surface area of the drawn yarn pirn is divided into four sections in the upward/downward direction and into four angular sections of 90 degrees in the circumferential direction; totally sixteen sections; and the hardness of these sixteen sections was measured and averaged and the average was defined as a pirn hardness.

(10) Spinning stability

A melt-spinning operation was carried out for two days per every example by using a melt-spinning apparatus having a four-end spinneret per one spindle. Also, undrawn yarns thus obtained were subjected to a drawing operation.

The spinning stability was determined from the number of yarn breakages generated in this period and the frequency of fluffs existing in the obtained drawn packages (a ratio of the number of packages having fluffs to the total number of packages) in accordance with the following criteria:

◎; yarn breakage is 0, fluff frequency is 5% or less.

○; yarn breakage is within two, fluff frequency is less than 10%.

x; yarn breakage is 3 or more, fluff frequency is 10% or more.

(11) Warp knit ability

The warp knit ability was estimated by using a 32-gauge tricot machine. A knitting construction was as follows:

Knit texture: half tricot

Runner length: front reed; 151 cm/480 courses back reed; 105 cm/480 courses

The knitting operation was continued for 24 hours, in which the yarn breakage due to the entanglement between single filaments was observed, from which the warp knit ability was determined in accordance with the following criteria:

◎; yarn breakage is 0.

○; yarn breakage is in a range from 1 to 2.

x; yarn breakage is 3 or more.

(12) Cheese dyeing

After imparting the composite fiber with twists of 120 T/m by Italian throwing machine, it was wound as a cheese on a paper tube of 81 mm diameter by a soft winder, manufactured by K.K. KAMITSU SEISAKUSHO, at a winding density of 0.25 g/cm$^3$. The paper tube was replaced with a dyeing tube of 69 mm outer diameter, and the cheese was dyed by a cheese dyeing machine (a small size cheese dyeing machine manufactured by K.K. HISAKA SEISAKUSHO).

[Dyeing condition]

Dye: disperse dye (Dianix Blue AC-E); 1% omf

Dispersant: Disper TL; 0.5 g/l pH: 5.0 (adjusted with acetic acid)

Flow rate: 40 1/min (the dyeing liquid was circulated from in to out)

Temperature and time: 120° C. and 30 min.

[Reduction/scouring condition]

Hydrosulfite; 1 g/l

Sunmol (phonetic) RC-700 (available from K.K. NIKKA KAGAKU); 1 g/l

Sodium hydroxide; 1 g/l

Flow rate; 40 1/min

Temperature and time: 80° C. and 30 min.

(13) Generation of white powder during the twisting/weaving operation

After the composite fiber was imparted with twists of 2000 T/m by a known double twister, the twist setting was carried out in an SBR type steam setter at 80° C.

The weaving operation for obtaining a plain weave fabric was continuously carried out for two days while using the twisted yarn thus obtained as weft under the following condition, during which the generation of white powder in the vicinity of guide or reeds was observed. In this regard, warp yarns were prepared by PTT drawn yarns of 56 dtex/24 f ("Solo (phonetic)": trade mark of ASAHI KASEI K.K.).

Warp density; 97 end/2.54 cm

Weft density; 98 end/2.54 cm

Loom; water jet loom ZW-303 manufactured by TSUDAKOMA KOGYO K.K.

Weaving speed; 450 rpm

The generation of white powder was estimated in accordance with the following criteria.

◎; no white powder was deposited.

○; white powder was deposited but no yarn breakage occurred.

x; white powder was significantly deposited and yarn breakages occurred.

(14) Estimation of fabric

After the resultant grey fabric was relaxed and scoured in a tented state, a series of dyeing, finishing and heat setting in a tented state was carried out.

The obtained fabric was inspected by a skilled person to determine a dyeing quality in the weft direction in accordance with the following criteria:

◎; extremely good with no defect such as uneven dyeing.

○; good with no defect such as uneven dyeing.

x; no good with defect such as uneven dyeing.

(15) Overall estimation

◎; spinning stability, post-treatment processibility and fabric quality are extremely good.

○; spinning stability, post-treatment processibility and fabric quality are good.

x; spinning stability, post-treatment processibility and fabric quality are not good.

EXAMPLES 1 TO 4 AND COMPARATIVE EXAMPLE 1

According to these Examples and Comparative example, it will be described how the content of trimethylene terephthalate cyclic dimer has effects on a composite fiber of a side-by-side type in which both components are PTT.

(Spinning conditions)

Pellet drying temperature and final moisture content: 110° C., 15 ppm

Extruder temperature: shaft A; 250° C. (high intrinsic viscosity side) shaft B; 250° C. (low intrinsic viscosity side)

Spin head temperature: 265° C.

Melting time: 12 minutes

Orifice diameter: 0.50 mm ϕ

Orifice length: 1.25 mm

Inclination of orifice relative to the vertical direction: 35 degrees

Number of orifices: 12 holes

Length of non-air blowing region: 225 mm

Temperature and relative humidity of cooling air: 22° C., 90%

Speed of cooling air: 0.5 m/sec

Composition of finishing agent:

fatty acid ester having 24 carbon atoms; 65 wt % polyoxyether; 30 wt % anionic type antistatic agent; 5 wt %

Finishing agent emulsion: aqueous emulsion of 30 wt % concentration

Takeup speed: 1100 m/min (Undrawn yarn)

Yarn size: selected to be 56 dtex after being drawn.

Moisture content: 0.5 wt %

Storage temperature: 22° C.

(Drawing conditions)

Drawing speed: 800 m/min

Rotational speed of spindle: 8000 rpm

Draw roll temperature: 55° C.

Hot plate temperature: 140° C.

Drawing stress: 0.25 cN/dtex

Interlace nozzle: M3C-B type manufactured by SANYO SEIKI K.K.; 0.2 MPa

Ballooning tension: 0.07 cN/dtex (Drawn yarn pirn)

Yarn size/number of filaments: 56.2 dtex/12 f

Fiber-fiber dynamic friction coefficient: 0.32

Winding weight: 2.5 kg

Number of twists: 10 T/m

Degree of intermigling: 25 point/m

Pirn hardness: 86

Two kinds of PTTs, different in trimethylene terephthalate cyclic dimer content from each other, were variously combined as shown in Table 1. The contents of trimethylene cyclic dimer in the resultant PTT composite fibers are shown in Table 1.

As is apparent from Table 1, the PTT composite fibers (Examples 1 to 4) having the contents of trimethylene terephthalate cyclic dimer within a range defined by the present invention had a favorable post-treatment processibility.

Further, the inventive PTT composite fibers exhibited a high developed crimpability even prior to the heat treatment, and as a result, were excellent in stretchability and stretch-back property as well as the resultant fabrics were superior in dyeing uniformity.

EXAMPLES 5 TO 8 AND COMPARATIVE EXAMPLES 2 AND 3

According to these Examples and Comparative examples, effects of the melting conditions will be described.

A fabric was obtained in the same manner as in Example 1 except that the melting time is variously changed as shown in Table 2. The resultant PTT fibers and the estimation of post-treatment processibility thereof are shown in Table 2.

As is apparent from Table 2, under the melting condition defined by the present invention (Examples 5 to 8), it was found that the content of trimethylene terephthalate cyclic dimer was prevented from increasing to result in the PTT composite fibers excellent in post-treatment processibility.

In Comparative examples 2 and 3, the content of cyclic dimer was high to cause the generation of white powder during the weaving and deteriorate the dyeing quality.

EXAMPLES 9 TO 12 AND COMPARATIVE EXAMPLE 4

According to these Examples and Comparative example, effects of the inclination of the spinning orifice relative to the vertical direction will be described.

The spinning operation was carried out in the same manner as in Example 1 except that the inclination of the spinning orifice relative to the vertical direction is variously changed as shown in Table 3. The results thereof are shown in Table 3.

As is apparent from Table 3, when the orifice having the inclination within a range defined by the present invention was used (Examples 9 to 12), the spinnability and the fiber size fluctuation U% were favorable. Contrarily, in Comparative example 4, the fiber size fluctuation U% was large and the dyeing quality was no good.

EXAMPLES 13 AND 14 AND COMPARATIVE EXAMPLE 5

According to these Examples and Comparative example, effects of a ratio between a diameter and a length of the spinning orifice will be described.

The spinning operation was carried out in the same manner as in Example 1 except that the ratio between the diameter and the length of the spinning orifice is variously changed as shown in Table 4. The results thereof are shown in Table 4.

As is apparent from Table 4, when the ratio between the diameter and the length of the spinning orifice was within a range defined by the present invention; that is, Examples 13 and 14, the spinnability and the fiber size fluctuation U% were favorable. Contrarily, in Comparative example 5, the fiber size fluctuation U% was large and the dyeing quality was no good.

EXAMPLES 15 TO 17 AND COMPARATIVE EXAMPLES 6 AND 7

According to these Examples and Comparative example, effects of the product of an average intrinsic viscosity and an extrusion linear speed will be described.

The spinning operation was carried out in the same manner as in Example 1 except that the orifice diameter is variously changed as shown in Table 5. The results thereof are shown in Table 5.

As is apparent from Table 5, when the product of an average intrinsic viscosity and an extrusion linear speed was within a range defined by the present invention (Examples 15 to 17), the spinnability and the fiber size fluctuation U% were favorable as well as the resultant fabrics were superior in dyeing uniformity. Contrarily, in Comparative examples 6 and 7, the fiber size fluctuation U% was large and the dyeing quality was no good.

EXAMPLES 18 TO 20 AND COMPARATIVE EXAMPLE 8

According to these Examples and Comparative example, effects of the degree of intermingling will be described.

Figure 6:
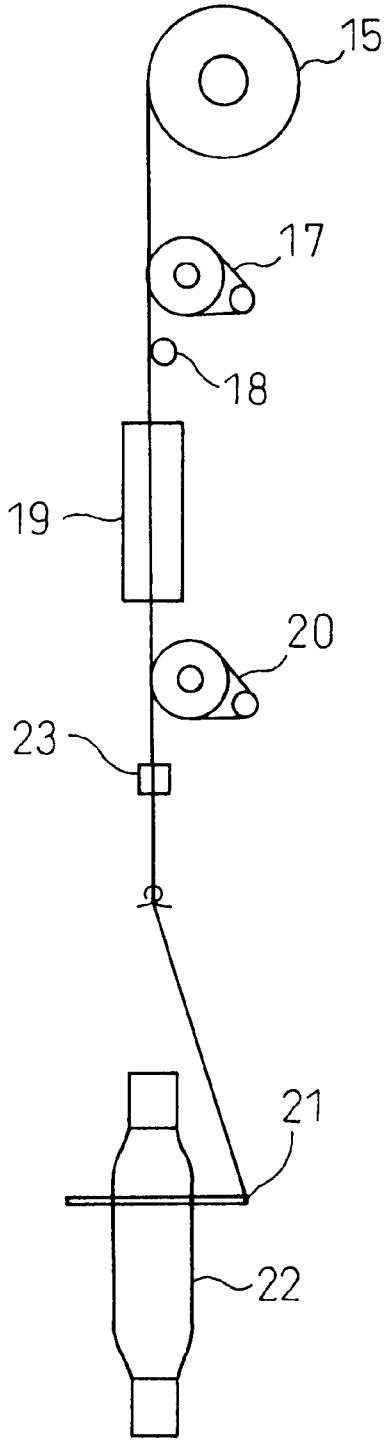
FIG. 6 is a schematic illustration of an example of a drawing apparatus used for the inventive production method.

Various degrees of intermingling were imparted as shown in Table 6 by the interlacing device 23 disposed downstream from the draw roll 20 shown in FIG. 6. The results thereof are shown in Table 6.

As is apparent from Table 6, there was no entanglement between single filaments during the knitting operation in Examples 18 to 20, whereby the favorable post-treatment processibility and the good dyeing quality of the knit fabric were resulted. Contrarily, in Comparative example 8, since no interlace was imparted to the composite fibers, the yarn breakages occurred due the entanglement of single filaments during the knitting operation.

EXAMPLES 21 TO 23 AND COMPARATIVE EXAMPLES 9 AND 10

According to these Examples and Comparative examples, effects of kinds and amounts of the finishing agent to be imparted will be described.

The spinning operations were carried out while using finishing agents prepared in accordance with components shown in Table 7. Results thereof are shown in Table 7.

As is apparent from Table 7, the PTT composite fiber imparted with the finishing agents defined by the present invention (Examples 21 to 23) was small in fiber-fiber dynamic friction coefficient and generated no white powder during the weaving operation, resulting in a favorable weavability. Contrarily, the fiber-fiber dynamic friction coefficient was large because an amount of the finishing agent to be imparted to the fibers is small in Comparative example 9 and the composition of the finishing agent is different from the range defined by the present invention in Comparative example 10, whereby white powder generated during the weaving operation to disturb the continuous weaving.

EXAMPLES 24 TO 26

According to these Examples, effects of kinds of other components used in the inventive composite fiber will be described.

As shown in FIG. 8, other polyester components were combined with PTT component and the spinning operation was carried out in the same manner as in Example 1 to result in the PTT composite fiber. Results thereof are shown in Table 8.

As is apparent from Table 8, even if the other polyester component was PET or PBT, favorable post-treatment processibility and dyeing quality were obtained.

EXAMPLES 27 TO 30

According to these Examples, effects of ratios between components A and B will be described.

PTT composite fibers were obtained in the same manner as in Example 1, except that the composition ratio was variously changed as shown in Table 9. Results thereof are shown in Table 9.

As is apparent from Table 9, when the composition ratio is in a range from 60/40 to 65/35, favorable strength at break, stretchability and stretchback property were obtained.

EXAMPLES 31 TO 34

According to these Examples, effects of the non-air blowing region which is a preferable aspect of the present invention will be described.

PTT composite fibers were obtained in the same manner as in Example 1, except that a length of the non-air blowing region was variously changed as shown in Table 10. Results thereof are shown in Table 10.

As is apparent from Table 10, if the length of the non-air blowing region is within a favorable range defined by the present invention, a preferable spinnability and an excellent developed crimpability are obtained, and the dyeing quality of the fabric is also good.

EXAMPLES 35 TO 38

According to these Examples, effects of the drawing stress which is a preferable aspect of the present invention will be described.

PTT composite fibers were obtained in the same manner as in Example 1, except that the drawing stress was variously changed as shown in Table 11. Results thereof are shown in Table 11.

As is apparent from Table 11, if the drawing stress is within the favorable range defined by the present invention, an excellent developed crimpability and a favorable fiber size fluctuation U% are obtained as well as a fabric quality is also good.

EXAMPLES 39 TO 41

According to these Examples, effects of the intrinsic viscosity and the content of trimethylene terephthalate cyclic dimer in two kinds of PTT consisting of PTT composite fibers different in single-filament size will be described.

Two kinds of PTTs, each having the intrinsic viscosity and the content of trimethylene terephthalate cyclic dimer shown in Table 12, were variously combined to result in PTT composite fibers of 84 dtex/12 f.

The spinning conditions were as follows:

(Spinneret)

Orifice diameter: 0.50 mm ϕ

Orifice length: 1.25 mm

Ratio between diameter and length of orifice: 2.5

Inclination of orifice relative to the vertical direction: 35 degrees

Number of orifices: 12

The ratio of the two kinds of polymers was 50:50, and the fiber size and the number of filaments after drawing were 84 dtex/12 f.

(Spinning conditions)

Drying temperature and final moisture content of pellets: 110° C., 15 ppm

Extruder temperature: shaft A; 260° C. shaft B; 260° C.

Spin head temperature: 265° C.

Polymer extrusion rate: selected so that drawn yarns have a fiber size of 84 dtex, respectively.

Non-air blowing region: 125 mm

Temperature and relative humidity of cooling air: 22° C., 90%

Speed of cooling air: 0.5 m/sec

Finishing agent: aqueous emulsion containing polyether ester as a main component; 30 wt % concentration Takeup speed: 1500 m/min (Undrawn yarn)

Fiber size: selected so that drawn yarns have a fiber size of 84 dtex, respectively.

Moisture content: 0.5 wt %

Storage temperature: 22° C.

(Drawing conditions)

Drawing speed: 400 m/min

Spindle rotational speed: 8000 rpm

Draw roll temperature: 55° C.

Hot plate temperature: 140° C.

Ballooning tension: 0.07 cN/dtex (Drawn yarn pirn)

Fiber size/number of filaments: 84.2 dtex/12 f

Winding weight: 2.5 kg

Number of twists: 20 T/m

Pirn hardness: 84

Physical properties of the resultant PTT composite fibers are shown in Table 12.

As is apparent from Table 12, even if the single filament sizes are different from each other, all the fibers had a favorable crimpability.

TABLE 1

| | Component A | | Component B | | | | | | Maximum | |
|---|---|---|---|---|---|---|---|---|---|---|
| | Intrinsic viscosity (dl/g) | Content of cyclic dimer (wt %) | Intrinsic viscosity (dl/g) | Content of cyclic dimer (wt %) | [η] × V (dl/g) (m/min) | Drawing stress (cN/dtex) | Spinnability | Content of cyclic dimer (wt %) | crimp elongation of developed crimps (%) | Rise temperature (° C.) |
| Example 1 | 1.26 | 0.8 | 0.92 | 1.1 | 6.6 | 0.15 | ⊚ | 1.9 | 170 | 57 |
| Example 2 | 1.26 | 0.8 | 0.82 | 1.1 | 6.3 | 0.17 | ⊚ | 1.8 | 180 | 58 |
| Example 3 | 1.00 | 1.0 | 0.82 | 1.1 | 5.6 | 0.19 | ⊚ | 1.7 | 150 | 59 |
| Example 4 | 0.92 | 1.1 | 0.72 | 2.5 | 5.0 | 0.17 | ⊚ | 2.2 | 120 | 58 |
| Comparative example 1 | 1.00 | 2.6 | 0.72 | 2.3 | 5.2 | 0.16 | ⊚ | 2.8 | 150 | 52 |

TABLE 1-continued

| | Shrinkage stress at 100° C. (cN/dtex) | U % (%) | Strength at break (cN/dtex) | Elongation at break (%) | Maximum crimp elongation after treatment with boiling water (%) | Elongation recovery speed (m/sec) | White powder during weaving | Dyeing quality | Overall estimation |
|---|---|---|---|---|---|---|---|---|---|
| Example 1 | 0.16 | 1.0 | 2.8 | 38 | 480 | 26 | ◎ | ◎ | ◎ |
| Example 2 | 0.18 | 1.1 | 2.7 | 39 | 370 | 25 | ◎ | ◎ | ◎ |
| Example 3 | 0.22 | 0.9 | 2.7 | 36 | 350 | 21 | ◎ | ◎ | ◎ |
| Example 4 | 0.21 | 0.9 | 2.5 | 37 | 390 | 19 | ○ | ◎ | ○ |
| Comparative example 1 | 0.16 | 1.1 | 2.3 | 35 | 260 | 19 | x | x | x |

TABLE 2

| | Melting temperature (° C.) | Melting time (min) | Content of cyclic dimer (wt %) | White powder during weaving | Dyeing quality | Overall estimation |
|---|---|---|---|---|---|---|
| Example 5 | 265 | 10 | 1.4 | ◎ | ◎ | ◎ |
| Example 6 | 265 | 15 | 1.8 | ◎ | ◎ | ◎ |
| Example 7 | 265 | 20 | 2.4 | ○ | ○ | ○ |

TABLE 2-continued

| | Melting temperature (° C.) | Melting time (min) | Content of cyclic dimer (wt %) | White powder during weaving | Dyeing quality | Overall estimation |
|---|---|---|---|---|---|---|
| Comparative example 2 | 265 | 25 | 2.7 | x | x | x |
| example 8 | 275 | 15 | 2.3 | ○ | ○ | ○ |
| Comparative example 3 | 285 | 15 | 2.9 | x | x | x |

TABLE 3

| | Spinning orifice | | | Maximum crimp elongation of developed | | | |
|---|---|---|---|---|---|---|---|
| | Diameter (mm ϕ) | Inclination (degree) | Spinnability | crimps (%) | U % (%) | Dyeing quality | Overall estimation |
| Comparative example 4 | 0.50 | 0 | x | 140 | 1.8 | x | x |
| Example 9 | 0.50 | 10 | ○ | 166 | 1.3 | ○ | ○ |
| Example 10 | 0.50 | 20 | ◎ | 173 | 1.1 | ◎ | ◎ |
| Example 11 | 0.50 | 30 | ◎ | 175 | 0.9 | ◎ | ◎ |
| Example 12 | 0.50 | 40 | ○ | 147 | 0.9 | ○ | ○ |

TABLE 4

| | Spinning orifice | | | | Maximum crimp elongation of developed | | | |
|---|---|---|---|---|---|---|---|---|
| | Length (mm) | Diameter (mm ϕ) | L/D | Spinnability | crimps (%) | U % (%) | Dyeing quality | Overall estimation |
| Comparative example 5 | 0.40 | 0.40 | 1.0 | x | 175 | 1.6 | x | x |
| Example 13 | 0.40 | 1.00 | 2.5 | ◎ | 170 | 0.9 | ◎ | ◎ |
| Example 14 | 0.40 | 1.60 | 4.0 | ◎ | 175 | 0.9 | ◎ | ◎ |

TABLE 5

| | Orifice diameter (mm) | Linear extrusion speed (m/min) | Average intrinsic viscosity [η] (dl/g) | [η] × V (dl/g) (m/min) | Spinna-bility | Maximum crimp elongation of developed crimps (%) | U % (%) | Dyeing quality | Overall estimation |
|---|---|---|---|---|---|---|---|---|---|
| Comparative example 6 | 0.3 | 16.9 | 0.95 | 16.0 | x | 170 | 1.7 | ○ | x |
| Example 15 | 0.4 | 9.5 | 0.95 | 9.0 | ◎ | 175 | 1.0 | ◎ | ◎ |
| Example 16 | 0.5 | 6.1 | 0.95 | 5.8 | ◎ | 160 | 1.0 | ◎ | ◎ |
| Example 17 | 0.6 | 4.2 | 0.95 | 4.0 | ○ | 150 | 1.3 | ○ | ○ |
| Comparative example 7 | 0.7 | 3.1 | 0.95 | 2.9 | x | 110 | 1.8 | x | x |

TABLE 6

| | Degree of intermingling (point/m) | Spinna-bility | Maximum crimp elongation of developed crimps (%) | U % (%) | Yarn breakages in knitting | Dyeing quality | Overall estimation |
|---|---|---|---|---|---|---|---|
| Comparative example 8 | 0 | ◎ | 174 | 1.1 | x | ◎ | x |
| Example 18 | 10 | ◎ | 170 | 1.0 | ◎ | ◎ | ◎ |
| Example 19 | 20 | ◎ | 170 | 1.0 | ◎ | ◎ | ◎ |
| Example 20 | 35 | ◎ | 165 | 0.9 | ◎ | ◎ | ◎ |

TABLE 7

| | Component A | Component B | Component C | Component D | Deposition percentage (wt %) | Fiber-fiber dynamic friction coefficient | Spinna-bility | White powder during weaving |
|---|---|---|---|---|---|---|---|---|
| Example 21 | 62 | 10 | 11 | 17 | 0.6 | 0.30 | ◎ | ◎ |
| Example 22 | 75 | 10 | 5 | 10 | 0.6 | 0.31 | ◎ | ◎ |
| Example 23 | 20 | 60 | 10 | 10 | 0.6 | 0.38 | ◎ | ◎ |
| Comparative example 9 | 62 | 10 | 11 | 17 | 0.2 | 0.42 | ○ | x |
| Comparative example 10 | 20 | 25 | 15 | 40 | 0.6 | 0.43 | ○ | x |

Note: Components of finishing agent
Component A: polyether (opposite ends are blocked with butyl group and methyl group; propylene oxide/ethylene oxide = 50/50 and molecular weight is 2000)
Component B: polyether (propylene oxide/ethylene oxide = 40/60 and molecular weight is 10000)
Component C: alkanesulfonate sodium salt having 15 carbon atoms
Component D: oleyl ether in which 10 units of polyoxyethylene are bonded

TABLE 8

| | | PTT | | Another polyester component | | | | | Maximum crimp |
|---|---|---|---|---|---|---|---|---|---|
| | Another poly-ester component | Intrinsic viscosity (dl/g) | Content of cyclic dimer (wt %) | Intrinsic viscosity (dl/g) | Content of cyclic dimer (wt %) | Melting tempera-ture (° C.) | [η] × V (dl/g) (m/min) | Content of cyclic dimer (wt %) | elongation of developed crimps (%) |
| Example 24 | PET | 1.00 | 1.0 | 0.50 | — | 280 | 4.6 | 1.9 | 32 |
| Example 25 | PET | 1.26 | 0.8 | 0.50 | — | 280 | 5.4 | 1.8 | 34 |
| Example 26 | PBT | 1.26 | 0.8 | 1.00 | — | 265 | 6.9 | 1.4 | 165 |

TABLE 8-continued

| | Shrinkage stress at 100° C. (cN/dtex) | U % (%) | Strength at break (cN/dtex) | Elongation at break (%) | Maximum crimp elongation after treatment with boiling water (%) | Elongation recovery speed (m/sec) | White powder during weaving | Dyeing quality | Overall estimation |
|---|---|---|---|---|---|---|---|---|---|
| Example 24 | 0.11 | 1.3 | 2.5 | 36 | 130 | 17 | ◎ | ○ | ○ |
| Example 25 | 0.17 | 1.1 | 3.2 | 36 | 180 | 18 | ◎ | ◎ | ◎ |
| Example 26 | 0.15 | 1.0 | 3.1 | 36 | 360 | 21 | ◎ | ◎ | ◎ |

Note.

PTT: polytrimethylene terephthalate

PET: polyethylene terephthalate

PBT: polybutylene terephthalate

TABLE 9

| | Ratio of high/low viscosity polymers | Spinnability | Curvature of single filament cross-section | Maximum crimp elongation of developed crimps (%) | U % (%) | Strength at break (cN/dtex) | Elongation at break (%) | Maximum crimp elongation after treatment with boiling water (%) | Elongation recovery speed (m/sec) | Dyeing quality | Overall estimation |
|---|---|---|---|---|---|---|---|---|---|---|---|
| Example 27 | 60/40 | ◎ | $8d^{0.5}$ | 150 | 0.9 | 2.7 | 35 | 310 | 21 | ◎ | ◎ |
| Example 28 | 65/35 | ◎ | $7d^{0.5}$ | 110 | 1.0 | 2.9 | 38 | 290 | 20 | ◎ | ◎ |
| Example 29 | 70/30 | ○ | $6d^{0.5}$ | 80 | 1.1 | 3.1 | 36 | 274 | 18 | ○ | ○ |
| Example 30 | 75/25 | ○ | $6d^{0.5}$ | 35 | 1.3 | 3.2 | 36 | 90 | 15 | ○ | ○ |

TABLE 10

| | Length of non-air blowing region (mm) | Spinnability | U % (%) | Strength at break (cN/dtex) | Elongation at break (%) | Maximum crimp elongation of developed crimps (%) | Dyeing quality | Overall estimation |
|---|---|---|---|---|---|---|---|---|
| Example 31 | 50 | ○ | 1.3 | 2.3 | 28 | 180 | ○ | ◎ |
| Example 32 | 100 | ◎ | 0.9 | 2.5 | 35 | 170 | ◎ | ◎ |
| Example 33 | 150 | ◎ | 0.9 | 2.6 | 37 | 168 | ◎ | ◎ |
| Example 34 | 180 | ◎ | 1.0 | 2.7 | 37 | 165 | ◎ | ◎ |

TABLE 11

| | Drawing stress (cN/dtex) | Elongation at break (%) | Maximum crimp elongation of developed crimps (%) | Dry heat shrinkage stress: Rise temperature (° C.) | Dry heat shrinkage stress: Shrinkage stress at 100° C. (cN/dtex) | U % (%) | Dyeing quality | Overall estimation |
|---|---|---|---|---|---|---|---|---|
| Example 35 | 0.31 | 31 | 182 | 60 | 0.20 | 0.8 | ◎ | ◎ |
| Example 36 | 0.18 | 36 | 148 | 58 | 0.17 | 0.9 | ◎ | ◎ |
| Example 37 | 0.13 | 44 | 95 | 55 | 0.12 | 1.3 | ○ | ◎ |
| Example 38 | 0.05 | 54 | 19 | 53 | 0.07 | 1.5 | ○ | ○ |

TABLE 12

| | Component A | | Component B | | | | | | Maximum | |
|---|---|---|---|---|---|---|---|---|---|---|
| | Intrinsic viscosity (dl/g) | Content of cyclic dimer (wt %) | Intrinsic viscosity (dl/g) | Content of cyclic dimer (wt %) | [η] × V (dl/g) (m/min) | Drawing stress (cN/dtex) | Spinnability | Content of cyclic dimer (wt %) | crimp elongation of developed crimps (%) | Rise temperature (° C.) |
| Example 39 | 0.88 | 1.1 | 0.64 | 2.4 | 7.6 | 0.15 | ○ | 2.3 | 170 | 57 |
| Example 40 | 0.84 | 1.1 | 0.64 | 2.4 | 7.4 | 0.17 | ◎ | 2.1 | 150 | 58 |
| Example 41 | 0.90 | 1.0 | 0.70 | 1.1 | 8.0 | 0.17 | ◎ | 2.0 | 150 | 58 |

| | Shrinkage stress at 100° C. (cN/dtex) | U % (%) | Strength at break (cN/dtex) | Elongation at break (%) | Maximum crimp elongation after treatment with boiling water (%) | Elongation recovery speed (m/sec) | White powder during weaving | Dyeing quality | Overall estimation |
|---|---|---|---|---|---|---|---|---|---|
| Example 39 | 0.16 | 1.0 | 2.0 | 41 | 420 | 20 | ○ | ◎ | ○ |
| Example 40 | 0.18 | 0.9 | 2.5 | 39 | 370 | 18 | ○ | ◎ | ○ |
| Example 41 | 0.21 | 0.9 | 2.1 | 41 | 390 | 19 | ◎ | ◎ | ◎ |

Capability of Exploitation in Industry

According to the present invention, it is possible to industrially obtain PTT composite fibers in a stable manner, which are free from troubles in the knitting/weaving process such as yarn breakage or others and having favorable stretchability and stretchback property as well as dyeing uniformity.

What we claimed is:

1. A polytrimethylene terephthalate composite fiber characterized in that the composite fiber is a plurality of single filament which comprises two kinds of polyester components laminated to each other in a side-by-side manner or an eccentric sheath-core manner, at least one of which components is polytrimethylene terephthalate and the composite fiber satisfies the following conditions (1) to (4):

(1) the content of trimethylene terephthalate cyclic dimer in polytrimethylene terephthalate is 2.5 wt % or less, (2) the fiber-fiber dynamic friction coefficient is from 0.2 to 0.4, (3) the degree of intermingling is from 2 to 60 point/m and/or the number of twists is from 2 to 60 T/m, and (4) the fiber size fluctuation U% is 1.5% or less.

2. A polytrimethylene terephthalate composite fiber as defined by claim 1, characterized in that one of the polyester components forming the single filament is polytrimethylene terephthalate and the other is polyester selected from a group of polytrimethylene terephthalate, polyethylene terephthalate and polybutylene terephthalate.

3. A polytrimethylene terephthalate composite fiber as defined by claim 1, characterized in that the composite fiber is a plurality of single filament which comprises two kinds of polyester components laminated to each other in a side-by-side manner and the composite fiber satisfies the following conditions (1) to (6):

(1) both of the polyester components are polytrimethylene terephthalate, (2) the content of trimethylene terephthalate cyclic dimer in polytrimethylene terephthalate is 2.2 wt % or less, (3) the fiber-fiber dynamic friction coefficient is from 0.3 to 0.4, (4) the degree of intermingling is from 10 to 35 point/m and/or the number of twist is from 10 to 35 T/m, and (5) the fiber size fluctuation U% is 1 2% or less, and (6) the maximum crimp elongation of developed crimps is 50% or more.

4. A polytrimethylene terephthalate composite fiber as defined by any one of claims 1 to 3, characterized in that both of the two kinds of polyester components forming the single filament comprise 90 mol % or more of polytrimethylene terephthalate, and the composite fiber has an average intrinsic viscosity from 0.7 to 1.2 dl/g, an elongation at break from 30 to 50% and a strength at break of 2.5 cN/dtex or more.

5. A polytrimethylene terephthalate composite fiber as defined by any one of claims 1 to 3, characterized in that the composite fiber is a plurality of single filament which comprises two kinds of polyester components laminated to each other in a side-by-side manner and a radius of curvature r ($\mu$m) of a boundary of the two components in the cross-section of the single filament is less than 10 $d^{0.5}$ (wherein d represents a single filament size (decitex)).

6. A polytrimethylene terephthalate composite fiber as defined by any one of claims 1 to 3, characterized in that the maximum crimp elongation of developed crimps is 50% or more.

7. A polytrimethylene terephthalate composite fiber as defined by any one of claims 1 to 3, characterized in that a crimp elongation recovery speed is 15 m/sec or more after the composite fiber is treated with boiling water.

* * * * *

UNITED STATES PATENT AND TRADEMARK OFFICE

CERTIFICATE OF CORRECTION

PATENT NO. : 6,555,220 B1
DATED : April 29, 2003
INVENTOR(S) : Tadashi Koyanagi et al.

It is certified that error appears in the above-identified patent and that said Letters Patent is hereby corrected as shown below:

Column 32,
Line 35, "1 2%" should read -- coated from 1.2% --.

Signed and Sealed this

Nineteenth Day of August, 2003

JAMES E. ROGAN
*Director of the United States Patent and Trademark Office*